United States Patent [19]

Tissari

[11] Patent Number: 4,623,429

[45] Date of Patent: Nov. 18, 1986

[54] TWIN-WIRE FORMING SECTION OF A PAPER MACHINE

[75] Inventor: Martti Tissari, Jyvaskyla, Finland

[73] Assignee: Valmet Oy, Finland

[21] Appl. No.: 535,750

[22] Filed: Sep. 26, 1983

Related U.S. Application Data

[63] Continuation of Ser. No. 298,469, Sep. 1, 1981, abandoned.

[30] Foreign Application Priority Data

May 15, 1981 [FI] Finland ..... 811514

[51] Int. Cl.[4] ..... D21F 1/36; D21F 9/02

[52] U.S. Cl. ..... 162/300; 162/301; 162/351; 162/352; 162/354

[58] Field of Search ..... 162/312, 300, 301, 303, 162/351, 353, 354, 358, 360, 295, 317, 203, 295, 352

[56] References Cited

U.S. PATENT DOCUMENTS

| | | | |
|---|---|---|---|
| 3,846,233 | 11/1974 | Kankaanpaa | 162/301 |
| 3,855,057 | 12/1974 | Hill | 162/301 |
| 3,944,464 | 3/1976 | Mears | 162/301 |
| 3,994,774 | 11/1976 | Halme et al. | 162/301 |
| 4,100,018 | 7/1978 | Wahren et al. | 162/301 |
| 4,153,504 | 5/1979 | Justus | 162/301 |
| 4,363,701 | 12/1982 | Kawac et al. | 162/301 |

FOREIGN PATENT DOCUMENTS

| | | | |
|---|---|---|---|
| 0274944 | 4/1913 | Fed. Rep. of Germany | 162/303 |
| 0010710 | 1/1978 | Japan | 162/301 |
| 2608 | 1/1978 | Japan | 162/300 |

*Primary Examiner*—Steve Alvo

[57] ABSTRACT

A lower wire loop of a paper machine has an initial single-wire portion of a dewatering zone defined by an initial portion of the wire of the lower wire loop, succeeded by an upper wire unit defining a twin-wire dewatering zone with a coinciding upper run of the wire of the lower wire loop. Dewatering occurs in the twin-water dewatering zone through the wire of the lower wire loop and the wire of the upper wire loop. The twin-wire dewatering zone is located above the level of the initial portion of the wire of the lower wire loop. A first dewatering element is a first forming shoe in the direction of the web run in the upper wire loop. The twin-wire zone curves in a first direction in a first sector on the first forming shoe so that dewatering occurs primarily through the wire of the lower wire loop. A second dewatering element is a second forming shoe following the first forming shoe and spaced therefrom in the lower wire loop. The twin-wire zone curves in a second direction opposite to the first direction in a second sector on the second forming shoe so that dewatering occurs primarily through the wire of the upper wire loop.

19 Claims, 5 Drawing Figures

FIG. 4
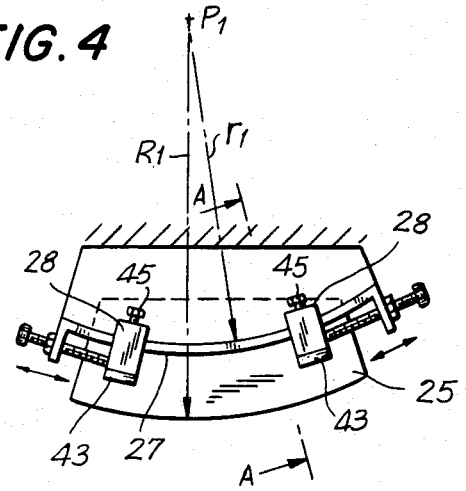
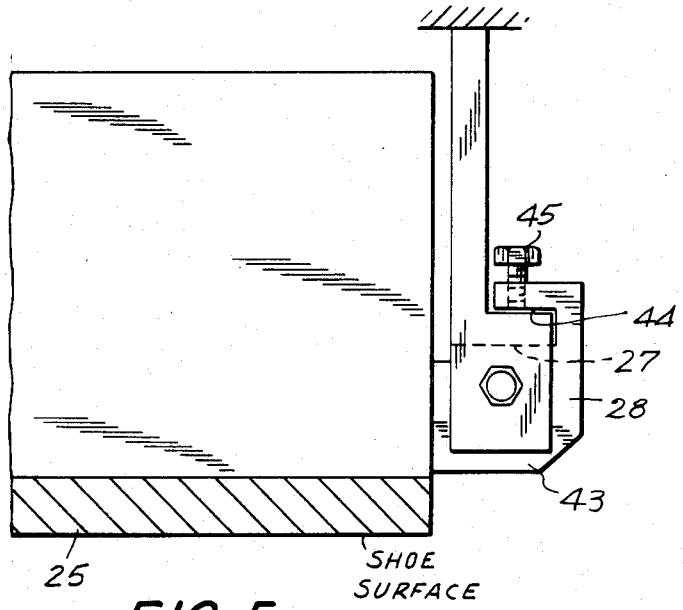
FIG. 5

TWIN-WIRE FORMING SECTION OF A PAPER MACHINE

This is a continuation, of application Ser. No. 298,469, filed Sept. 1, 1981, now abandoned.

BACKGROUND OF THE INVENTION

The present invention relates to a twin-wire forming section of a paper machine.

The twin-wire forming section comprises a lower wire loop, like a modified forming section of a Fourdrinier part to be modernized, defining an initial single-wire portion of the dewatering zone. This is followed by an upper wire loop which, together with the coinciding upper run of the wire of the lower wire loop, defines a twin-wire dewatering zone. Dewatering occurs in the twin-wire dewatering zone through the wires of both the lower wire loop and the upper wire loop.

In known twin-wire formers commonly used in gap formers, the stock is fed onto the wire section as a lean pulp slurry. Then, either immediately, or after a short single-wire run, a violent dewatering from the stock web begins in both directions, or in the same direction as in the single-wire portion. As a result, fillers such as, for example, kaolin added to the stock and also fine fibers, escape in a considerable amount with the water. This, of course, noticeably impairs the quality of the paper web and particularly impairs those properties obtaining which are sought in the paper web by the use of fillers. Furthermore, a simultaneous and violent two-sided dewatering easily causes a weakening of the middle layer of the web, which leads to a low internal bond strength.

Indicative of the state of the art relating to the present invention is U.K. patent application No. 2,003,952 of Beloit Walmsley Limited, UK and U.S. Pat. No. 3,846,233 of the present inventor and U.S. Pat. No. 4,472,244 of the present inventor.

U.S. Pat. No. 3,946,233 discloses a wire section of a paper machine comprising an initial single-wire portion, followed by a twin-wire portion. The twin-wire portion is curved at least as its initial part, guided by a dewatering roller or a dewatering box. In this known wire section, the initial single-wire portion is so long that while the dewatering cautiously occurs in the initial part, the stock web has time prior to entering the twin-wire portion to attain such a felting degree that the fibers are no longer able to move appreciably with reference to each other. Furthermore, the twin-wire section guided by the dewatering roller or by the dewatering box is curved downwards so that the dewatering in this curved portion principally occurs, due to the effect of centrifugal force, through the upper wire and in a direction opposite that in the initial single-wire portion. The object is to reduce the escape of the additives, such as fillers and fine substances of the stock, from the stock web and to improve the internal bond strength in the paper to be produced.

U.S. Pat. No. 4,472,244 discloses a wire section of a paper machine in which a twin-wire dewatering zone on the side of the upper wire unit consists of a curved forming shoe having an unperforated cover. The forming shoe is preceded by a curved dewatering zone which has a forming roller or equivalent, as a shoelike means. The dewatering occurs primarily through the upper wire in the dewatering zone. The water, which is removed from the web through the upper wire, is conducted to the side or sides of the paper machine, substantially without using suction energy, by devices of the upper wire unit, or units, which are positioned above the forming shoe.

Suction rollers or boxes are used in several twin-wire formers of the prior art. The rotating suction rollers are expensive components. Furthermore, both the suction rollers and suction boxes consume a considerable magnitude of suction energy. Also, the apparatus is rather complicated in structure, and it is desirable to improve operating safety.

SUMMARY OF THE INVENTION

The principal object of the invention is to provide a new and improved twin-wire forming section of a paper machine having an initial single-wire portion.

An object of the invention is to provide a twin-wire forming section of a paper machine, which twin-wire forming section enables the rebuilding of old single-wire Fourdrinier machines advantageously to twin-wire sections to provide dewatering from the web in two directions, with known favorable effects in web forming.

Another object of the invention is to provide a twin-wire forming section of a paper machine having an upper wire unit which may be accommodated in a small space and which may easily be removed, if necessary, for changing the upper wire, or other maintenance.

Still another object of the invention is to provide a twin-wire forming section of a paper machine, in which twin-wire forming section, if necessary, the methods and apparatus of Finnish Pat. No. 64,210, may be applied to the control of the distribution of filler and/or fines transversely to the plane of the web.

Another object of the invention is to provide a twin-wire forming section of a paper machine, in which section neither suction rollers nor suction boxes are necessary, but in which forming sections centrifugal force or kinetic energy may be utilized for creating the dewatering pressure.

Still another object of the invention is to provide a twin-wire forming section of a paper machine in which the twin-wire run is guided by structurally simple forming shoes having closed solid covers with smooth surfaces, the positions of the shoes being readily adjustable.

The foregoing objects are attained by the twin-wire forming section of the invention, of which the twin-wire portion of the dewatering zone is entirely, or at least in its essential parts, located above the level of the initial portion of the lower wire. At least two curved dewatering elements are included for guiding the twin-wire portion. The first dewatering element in the direction of the web run is a first solid-covered forming shoe placed within the upper wire loop. The twin-wire portion is curved upward on the first forming shoe in a suitable sector, so that dewatering occurs primarily through the lower wire. The first forming shoe is followed by a second forming shoe, or an equivalent forming roller device, positioned within the lower wire loop. The twin-wire portion is curved downward on the second forming shoe in a suitable sector, so that dewatering occurs primarily through the upper wire.

BRIEF DESCRIPTION OF THE DRAWINGS

For a fuller understanding of the invention, reference is had to the following description, taken in connection with the accompanying drawings, in which:

FIG. 4 is an elevational view, illustrating adjustment of a forming shoe in accordance with the present invention; and FIG. 5 is a left-side view of FIG. 4.

DESCRIPTION OF PREFERRED EMBODIMENTS

Figure 1:
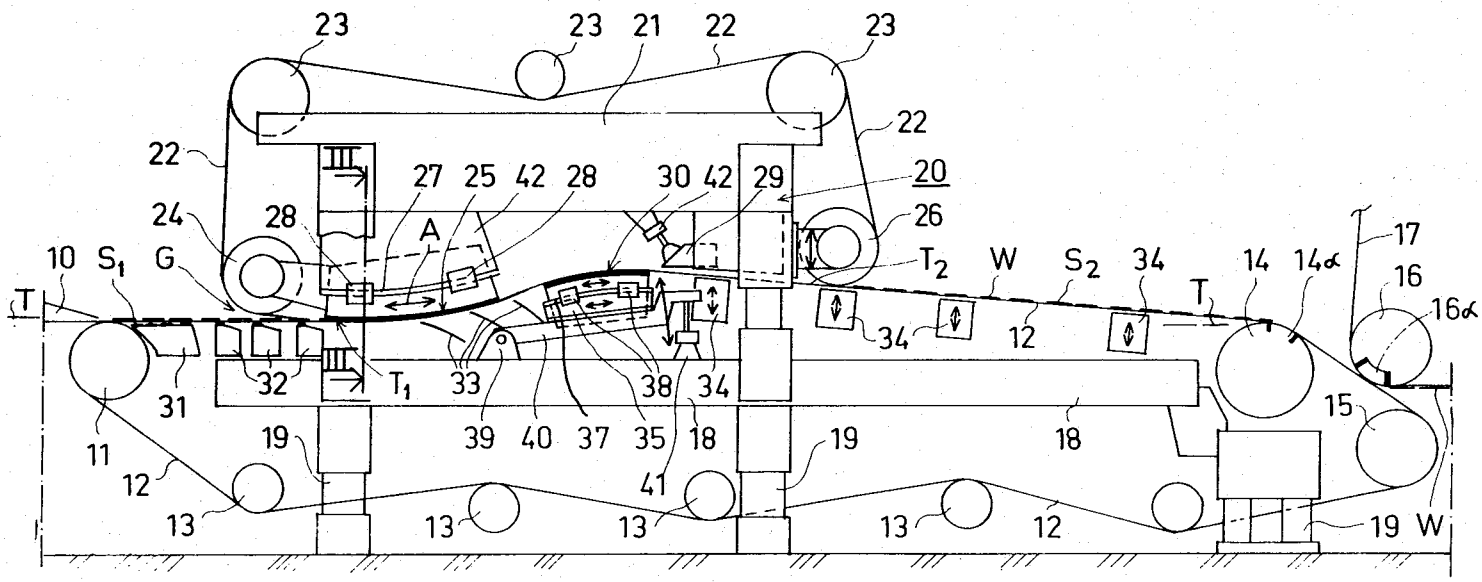
FIG. 1 is a schematic elevation of an embodiment of the twin-wire forming section of the paper machine of the invention.
Figure 2:
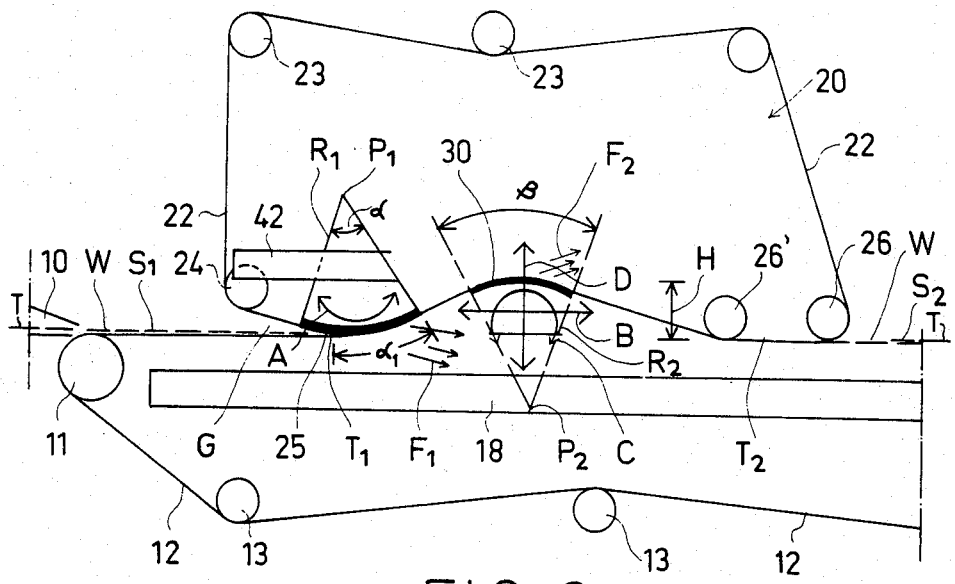
FIG. 2 is a schematic longitudinal side elevation of the twin-wire portion of the forming section of FIG. 1.

As shown in FIGS. 1 and 2, the twin-wire forming section of the invention includes a lower wire 12 onto which, in proximity with the breast roller 11, the stock suspension is fed by the converging lip part 10 of the headbox. The run of the lower wire 12 is guided by leading rollers 13, a couch roller 14 and a forward drive roller 15. On the downward sloping run between the rollers 14 and 15, the web W is detached from the lower wire 12 and is directed to a pick-up felt 17 by a suction zone 16α of a pick-up roller 16. The pick-up felt 17 transfers the web W further into the press section of the paper machine (not shown in the Figs.).

The lower wire section is, for example, essentially a conventional Fourdrinier part of a paper machine to be modernized. A forming board 31, foil devices 32 and flat suction boxes 34 are provided as dewatering equipment within the lower wire loop 12. The frame construction of the old Fourdrinier part is known and comprises horizontal beams 18 and vertical columns which include intermediate pieces 19 which are removable for changing the wire 12. The upper run of the old Fourdrinier apparatus is on the level T—T (FIG. 2).

The purpose for the modernization of the Fourdrinier section is generally to intensify its dewatering capacity and thus, as far as that is concerned, to make it possible to increase the speed of the paper machine. Another purpose of the modernization of the wire section is to obtain for the paper web to be produced those good characteristics pertaining to a twin-wire web forming process in which dewatering occurs through both surfaces of the web. In this respect, an example is Finnish Pat. No. 50648, which discloses the so-called "Sym-Former" (Finnish trademark) of the inventor.

The Fourdrinier apparatus is modernized by providing it with an upper wire unit 20 comprising a wire loop 22 positioned above the Fourdrinier part. The wire of the upper wire loop 22 is guided by leading rollers 23, 24 and 26. The upper wire unit 20 includes a framework 21 for supporting vertical columns of the old frame. If necessary, the upper wire unit 20 may be made removable at its running position above the lower wire unit, so that the unit as a whole, or part thereof, may be lifted from its position. This may be accomplished, for example, by a crane utilized to change the upper wire 22, or for other purposes relating to the paper machine.

The upper wire unit 20 comprises a curved, closed surface, first forming shoe 25 which is connected by means of side beams 42 to the frame 21 of said upper wire unit. The upper wire unit 20 includes a water collecting saveall 29 which may be adjusted in position. The leading rollers 24 and 26 of the upper wire 22 are adjustable in position for appropriately guiding the lower run of said upper wire.

The Fourdrinier is further modernized by a second forming shoe 30 located within the lower wire loop 12. The second forming shoe 30 is spaced from, and follows, the forming shoe 25. Simultaneously, the upper run of the lower wire 12 is partly changed to be above the level T—T of the old wire run. For this purpose, the old flat suction boxes 34 which may be included in the apparatus (FIG. 1) are raised higher and are made adjustable in position.

The geometry of the twin-wire forming section of the invention is shown most clearly in FIG. 2. The twin-wire portion is confined between the lines $T_1$ and $T_2$. The run of the twin-wire portion $T_1$–$T_2$ is mainly above the level T—T. The twin-wire portion is preceded by a single-wire portion $S_1$ at which the initial dewatering is provided by the dewatering devices 31 and 32 (FIG. 1) through the lower wire 12. This initial dewatering is most appropriately carried out relatively cautiously, and so that the web W has time to obtain a suitable degree of felting before coming to the twin-wire portion $T_1$–$T_2$. All the measures for controlling web formation found good in the paper maker's practice, and which are commonly utilized in Fourdrinier machines, may be utilized at the single-wire portion $S_1$. These are, for example, the velocity of the stock jet discharging from the headbox lip part 10 in relation to the speed of the wire 12 and the angle of said jet in relation to the wire plane T—T.

A twin-wire run, curved upward by the first forming shoe 25 follows in the area of the sector, after the line $T_1$, the twin-wire run being initially curved upwardly over the sector of first forming shoe 25. In this run, dewatering occurs through the lower wire 12 in the direction of arrows $F_1$. Thereafter, the wires 12 and 22 constitute a short straight run which is followed in the sector β by a curved portion guided by the second forming shoe 30, located within the lower wire loop 12. The second forming shoe 30 is followed by a straight run until a roller 26′ in FIG. 2 and a roller 26 in FIG. 1. A second single-wire portion $S_2$ begins after the roller 26 or 26′. Dewatering occurs in the region of the second shoe 30 due to the effect of centrifugal forces in the direction shown by arrows $F_2$, through the upper wire 22.

The former unit of the invention, and particularly its twin-wire portion, offers several different adjustment possibilities for controlling the web formation. These adjustments include, for example, arranging of the position of the leading rollers 24 and 26, or 26′, which guide the lower run of the upper wire. In addition, the first forming shoe 25 and the second forming shoe 30 are adjustable in position in many ways, as follows. According to FIG. 2, the surface of the first forming shoe 25, guiding the upper wire 22, has a given radius of curvature $R_1$, for example, the center of curvature being $P_1$. Correspondingly, the second forming shoe 30 has a given radius of curvature $R_2$, for example, the center of curvature being $P_2$. The first shoe 25 is mounted in a manner whereby it is pivotable around the point $P_1$. This adjustment is illustrated by arrow A in FIGS. 1 and 2. Correspondingly, the second shoe 30 is mounted in a manner whereby it is adjustable horizontally, as shown by an arrow B in FIG. 2, and vertically, as shown by an arrow D in FIG. 2, as well as being mounted in a manner whereby it is pivotable around a point $P_2$, as indicated by an arrow C in FIG. 2.

The radii of curvature $R_1$ and $R_2$ of the surfaces of the forming shoes 25 and 30, respectively, need not necessarily be constant, but may decrease evenly and continuously in the run direction of the web W, for example, in order to increase the dewatering pressure. Furthermore, it is advantageous that the front and back edges of the shoes 25 and 30 have smaller curvatures and certain types of rounded edges, in order to reduce the rubbing and wear of the wires 12 and 22.

The widths of the shoes 25 and 30 in the running direction of the web W, that is, the magnitudes of the sectors $\alpha$ and $\beta$ may be dimensioned "super large", so that an adjustment of the twin-wire portion may be limited, if necessary, only to cover the arcs $\alpha_1$ (FIG. 2) and $\beta_1$ (not shown in the Figs.) within said sectors. As shown in FIG. 2, this is also accomplished for the part of the forming shoe 25 in which the angle $\alpha_1$ is smaller than the angle $\alpha$, so that a gap G is formed between the wires 22 and 12. The wires approach each other at an angle $\alpha-\alpha_1$ in the area of the gap G.

The angle $\alpha$ is about 15° . . . 25°, most appropriately about 20°. The angle $\beta$ is about 20° . . . 35°, most appropriately about 30°. The radius of curvature $R_1$ of the first forming shoe 25 is about 3 to 6 meters. As stated, the radius of curvature $R_1$ may decrease along the cross-section of the shoe 25. The radius of curvature $R_2$ of the second forming shoe 30 is about 0.8 to 3 meters. The radius of curvature $R_2$ is most appropriately smaller than the radius of curvature $R_1$, so that the dewatering pressure increases towards the end of the twin-wire portion $T_1$–$T_2$. The top height H of the twin-wire run from the level T—T at the middle line of the shoe 30, as shown in FIG. 2, is about 0.4 . . . 1 meter.

The surfaces of the first and second forming shoes 25 and 30, respectively, which guide the wires 22 and 12, are of wear resistant material having minimum friction. Furthermore, these surfaces are lubricated by the water escaping from the web W. The surfaces of the forming shoes 25 and 30 are either plain, or provided with appropriate grooves or slots. The openings of the grooves or slots may be located particularly in the area at the front edges of the shoes 25 and 30 in order to provide space for water escaping from the web W.

Figure 3:
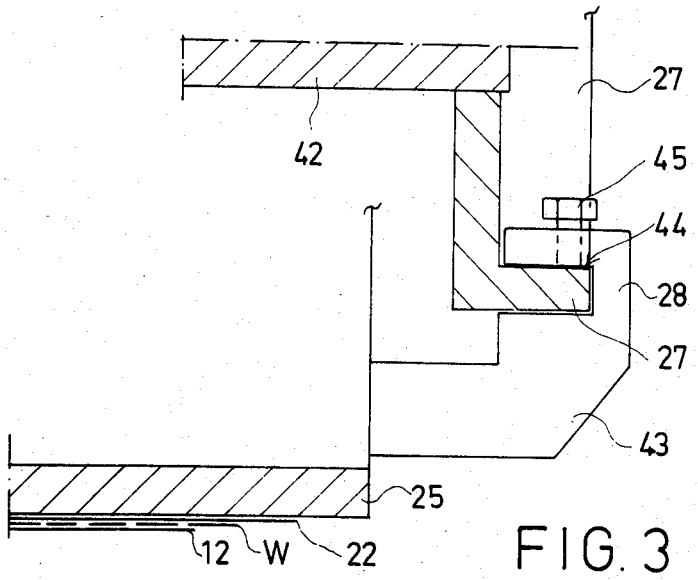
FIG. 3 is a fragmentary cross-elevational view, on an enlarged scale, taken along the lines III—III, of FIG. 1.

FIGS. 1 and 3 show an embodiment of a mechanism for the adjustment of the position of the shoes 25 and 30. The first shoe 25 is adjustably suspended on curved guides 27, provided at both ends of said shoe. The center of curvature of the curved guides 27 is the same as the center of curvature $P_1$ of the wire guiding outer surface of the shoe 25. The guides 27 are fastened by fasteners 28, the structure of which is illustrated in FIG. 3. The fasteners 28 consist of parts 43 affixed to the adjustable shoe 25. The fasteners 28 have notches 44 formed therein. Clamping screws 45 are provided in the notches 44 to lock the shoe 25 in a desired position.

Equivalent guides 37 and fasteners 38 are provided for the second shoe 30. The shoe 30 is affixed to a pivotable support frame 40 connected at its front part by pivot axles 39 to the frame beams 18 of the paper machine. The rear part of the support frame 40 is operated via a pivoting device such as, for example, a worm gear by means of which said frame and the shoe 30 supported thereby may be pivoted around the axles 39.

Furthermore, the shoe 30 is affixed to an intermediate frame 35 by guides 37 and fasteners 38. The intermediate frame 35 is mounted on the support frame 40 for movement on a substantially horizontal level. This results in the second forming shoe 30 being adjustably movable in the direction of the arrow B in FIG. 2. A moving device 41 (FIG. 1) provides a substantially vertical adjustment, shown by the arrow D in FIG. 2. The adjustment along the guides 37 corresponds the pivotal movement indicated by the arrow C in FIG. 2.

FIG. 1 shows water guiding plates 33 which lead water escaping from the web W through the wire 12 in the area of the first shoe 25 into a lower water-collecting saveall (not shown in the Figs.). The second shoe 30 is followed by a water-collecting trough 29, located within the upper wire loop 22, for gathering water removed through the wire 22 in the area of said second shoe. The position of the water-collecting trough 29 is adjustable via a moving device such as, for example, a worm gear 42 (FIG. 1).

Due to gravity force, the water which is removed through the lower wire 12 may be more easily collected and led to the water guiding plates 33 than that dewatered through the upper wire 22. Thus, the operation of the former unit of the invention is controlled by several different adjusting devices, as hereinbefore described, so that water is removed upwardly through the upper wire 22 in the area of the second forming shoe 30, only to an extent which is necessary and indispensable to the desired characteristics of the web W, such as, for example, the distribution of fillers and fines or internal bond strength.

Several modifications and deviations from the embodiment illustrated in the Figs. are possible within the scope of the invention. Thus, the second shoe 30 may, if necessary, be replaced by a forming roller having a relatively large diameter and most appropriately a smooth surface and a solid shell. Furthermore, a suction roller may be utilized, if necessary. The suction roller is, however, an expensive component. In one advantageous embodiment of the invention, the radius of curvature $R_1$ of the first shoe 25 continuously decreases from the front edge to the back edge, and such stepless decrease of the radius of curvature of the shoe continues in the area of the second shoe 30. In this manner, a continuously increasing dewatering pressure is attained.

Although the invention has been explained as being applied to the modernization of an existing Fourdrinier section, the invention is equally applicable to the forming section of a new paper machine. In such case, the frame structure of the forming section and the various adjustments of the forming shoes may be selected more freely than in a modernization project.

Although the adjustment possibilities of the first and second forming shoes 25 and 30 are hereinbefore emphasized, said forming shoes 25 and 30 may be stationarily mounted, if necessary, particularly when standard paper grades are produced in the forming section. In many cases, however, adjustment of the forming shoes 25 and/or 30 within certain limits is advantageous, even in the production of standard paper grades. This is due to the fact that these adjustments enable the operational optimum of the wire part to be determined in connection with the run-in of the forming section with respect to the different factors in the web formation.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In a twin-wire forming section of a paper machine including a lower wire loop defining an initial single-wire portion having a substantially planar run, said single-wire portion having dewatering means and being defined by an initial portion of the wire of said lower wire loop, said initial single-wire portion being followed in the direction of web run by an upper wire loop having a lower run forming a twin-wire portion with a coinciding upper run of the wire of said lower wire loop, said twin-wire portion having dewatering means for dewatering a web in said twin-wire portion through the wire of said lower wire loop and the wire of said upper wire loop, the improvement comprising:

said twin-wire portion being located above the level of the planar run of said initial single-wire portion;

said twin-wire portion including at least two curved dewatering elements successively situated in the direction of web run; wherein a first of said dewatering elements in the direction of web run comprises a first forming shoe situated within said upper wire loop, said twin-wire portion curving upwardly over a first sector on said forming shoe so that dewatering occurs primarily through the wire of said lower wire loop;

a second of said dewatering elements in the direction of web run comprises a second forming shoe situated within said lower wire loop, said twin-wire portion curving downwardly over a second sector on said second forming shoe so that dewatering occurs primarily through the wire of said upper wire loop;

first guide and moving means in operative proximity with said first forming shoe for adjustably positioning the same independently from said second shoe; and second separate guide and moving means in operative proximity with said second forming shoe for adjustably positioning the same independently from said first shoe; wherein said first guide and moving means comprise first means for pivoting said first forming shoe about a pivot point; and said second guide and moving means comprise second separate means for pivoting said second forming shoe about a second pivot point; and said second guide and moving means additionally comprise first means for adjusting position of said second shoe in a direction substantially parallel to the direction of web run; and second means for adjusting position of said second forming shoe in a direction substantially perpendicular to the direction of web run.

2. A twin-wire forming section as claimed in claim 1, wherein said first and second forming shoes are in said twin-wire portion and have solid-covered smooth surfaces.

3. A twin-wire forming section as claimed in claim 1, wherein the substantially planar run of said initial single-wire portion is substantially horizontal.

4. A twin-wire forming section as claimed in claim 1, wherein said first forming shoe has an arc in a range between substantially 15 to 25 degrees in the direction of the web run.

5. A twin-wire forming section as claimed in claim 1, wherein said second forming shoe has an arc in a range between substantially 20 to 35 degrees in the direction of the web run.

6. A twin-wire forming section as claimed in claim 1, wherein each of said first and second forming shoes has a surface with a front edge having grooves and slots formed therein to provide space for water escaping from the web.

7. A twin-wire forming section as claimed in claim 1, wherein each of said first and second forming shoes has an arc and a radius of curvature, the radius of curvature of each of said shoes decreasing substantially evenly and continuously in the direction of the web run for increasing the dewatering pressure.

8. A twin-wire forming section as claimed in claim 1, further comprising a single-wire portion succeeding said twin-wire portion in the upper run of said lower loop and having dewatering means, and a pick-up roller for detaching the web from the wire after said succeeding single-wire portion.

9. A twin-wire forming section as claimed in claim 1, further comprising a water-collecting trough positioned next-succeeding said second forming shoe in said upper wire loop, and third moving means in operative proximity with said trough for selectively adjusting the position of said trough.

10. A twin-wire forming section as claimed in claim 1, wherein each of said first and second forming shoes has an arc and a center of curvature, and said respective pivot points are substantially located at said respective centers of curvature.

11. A twin-wire forming section as claimed in claim 4, wherein said first forming shoe has a radius of curvature of a magnitude in a range between substantially 3 to 6 meters.

12. A twin-wire forming section as claimed in claim 5, wherein said second forming shoe has a radius of curvature of a magnitude in a range between substantially 0.8 to 3 meters.

13. A twin-wire forming section as claimed in claim 8, further comprising a pick-up felt, and wherein said dewatering means in said succeeding single-wire portion comprises a plurality of flat suction boxes and said pick-up roller transfers the detached web to said pick-up felt.

14. A twin-wire forming section as claimed in claim 1, wherein each of said first and second forming shoes has an arc and a radius of curvature and the radius of curvature of one of said shoes decreases substantially evenly and continuously in the direction of the web run for increasing the dewatering pressure.

15. A twin-wire forming section as claimed in claim 13, wherein said one of said shoes is said first shoe.

16. A twin-wire forming section as claimed in claim 14, wherein said twin-wire portion being disposed at a height of about 0.4 to 1 meter above the planar run of said single wire portion at a mid-point of said second shoe.

17. A twin-wire forming section as claimed in claim 1, wherein said lower wire loop has a modified forming section of a Fourdrinier part.

18. A twin-wire forming section as claimed in claim 1, wherein said first and second pivoting means comprise curved guides provided along said shoes in the direction of web run, and adjustable fasteners affixed to each of said shoes and engaging a respective guide.

19. In a twin-wire forming section of a paper machine including a lower wire loop defining an initial single-wire portion having a substantially planar run, said single-wire portion having dewatering means and being defined by an initial portion of the wire of said lower wire loop, said initial single-wire portion being followed in the direction of web run by an upper wire loop having a lower run forming a twin-wire portion with a coinciding upper run of the wire of said lower wire loop, said twin-wire portion having dewatering means for dewatering a web in said twin-wire portion through the wire of said lower wire loop and the wire of said upper wire loop, the improvement comprising:

said twin-wire portion being located above the level of the planar run of said initial single-wire portion;

said twin-wire portion including at least two curved dewatering elements successively situated in the direction of web run; wherein a first of said dewatering elements in the direction of web run comprises a first forming shoe situated within said upper wire loop, said twin-wire portion curving upwardly over a first sector of said forming shoe so that dewatering occurs primarily through the wire of said lower wire loop;

a second of said dewatering elements in the direction of web run comprises a second forming shoe situated within said lower wire loop, said twin-wire portion curving downwardly over a second sector on said second forming shoe so that dewatering occurs primarily through the wire of said upper wire loop;

guide means and moving means in operative proximity with said first and second forming shoes for adjustably positioning said first and second forming shoes;

said guide means and moving means comprising curved guides provided along said shoes in the direction of web run;

adjustable fasteners affixed to each of said shoes and engaging respective guides;

a clamping screw being provided with respect to a fastener of one of said shoes and adapted to affix said respective fastener, and thereby said one of said shoes, in position;

a pivotable support frame provided with respect to said other of said first and second shoes;

an intermediate frame movably mounted upon said pivotable support frame for movement in a direction substantially parallel to the direction of web run, said respective guides of said other shoe being mounted upon said intermediate frame; and means for moving said other shoe in a direction substantially perpendicular to the direction of web run;

whereby said other shoe is adjustable in the direction substantially parallel to the direction of the web run, in the direction substantially perpendicular to the direction of the web run, and in a pivoting direction about a pivot point of said support frame.

* * * * *